US011396798B2

(12) United States Patent
Jordan, Jr. et al.

(10) Patent No.: US 11,396,798 B2
(45) Date of Patent: Jul. 26, 2022

(54) DOWNHOLE PUMP AND METHOD FOR PRODUCING WELL FLUIDS

(71) Applicant: Liquid Rod Lift, LLC, Houston, TX (US)

(72) Inventors: Henry Joe Jordan, Jr., Willis, TX (US); Ryan Matthew Ward, Tomball, TX (US); Christian Atilano, Houston, TX (US)

(73) Assignee: Liquid Rod Lift, LLC, Houston, TX (US)

( * ) Notice: Subject to any disclaimer, the term of this patent is extended or adjusted under 35 U.S.C. 154(b) by 45 days.

(21) Appl. No.: 17/002,637

(22) Filed: Aug. 25, 2020

(65) Prior Publication Data

US 2021/0062626 A1 Mar. 4, 2021

Related U.S. Application Data

(60) Provisional application No. 63/026,548, filed on May 18, 2020, provisional application No. 62/893,090, filed on Aug. 28, 2019.

(51) Int. Cl.

| | |
|---|---|
| ***E21B 43/12*** | (2006.01) |
| ***E21B 33/124*** | (2006.01) |
| ***E21B 33/12*** | (2006.01) |
| ***E21B 34/08*** | (2006.01) |
| ***F04B 53/10*** | (2006.01) |

(Continued)

(52) U.S. Cl.

CPC ..... *E21B 43/126* (2013.01); *E21B 33/124* (2013.01); *E21B 33/1208* (2013.01); *E21B 34/08* (2013.01); *E21B 43/129* (2013.01); *F04B 53/10* (2013.01); *F04B 53/14* (2013.01);

(Continued)

(58) Field of Classification Search

CPC ..... E21B 43/12; E21B 43/121; E21B 43/126; E21B 43/127; E21B 43/128

See application file for complete search history.

(56) References Cited

U.S. PATENT DOCUMENTS

| | | | |
|---|---|---|---|
| 731,241 | A | 6/1903 | Steiner |
| 2,277,306 | A | 3/1942 | Coffey |

(Continued)

FOREIGN PATENT DOCUMENTS

| | | | |
|---|---|---|---|
| WO | 2010002841 | A2 | 1/2010 |
| WO | 2011069517 | A1 | 6/2011 |
| WO | 2013086623 | A1 | 6/2013 |

OTHER PUBLICATIONS

International Search Report and Written Opinion dated Nov. 30, 2020 for Application No. PCT/US2020/047980.

(Continued)

*Primary Examiner* — David Carroll

(74) *Attorney, Agent, or Firm* — Patterson + Sheridan, LLP

(57) ABSTRACT

A method of producing fluid from a wellbore includes operating a pump located proximate to a zone of fluid influx in the wellbore to draw a fluid from a reservoir into the wellbore at the zone of fluid influx. A first section of a tubing string is coupled to, and extends above, the pump, and a second section of the tubing string is coupled to, and extends below, the pump. A packer seals a first annular space around the first section of the tubing string. The method further includes operating the pump to move the fluid from the second section of the tubing string and into the first section of the tubing string.

17 Claims, 11 Drawing Sheets

(51) Int. Cl.
*F04B 53/14* (2006.01)
*F04B 53/20* (2006.01)
*E21B 33/129* (2006.01)

(52) U.S. Cl.
CPC ..... *F04B 53/20* (2013.01); *E21B 33/1294* (2013.01); *E21B 2200/04* (2020.05)

(56) References Cited

U.S. PATENT DOCUMENTS 2,311,212 A 2/1943 Coberly
2,420,151 A 5/1947 Renouf et al.
2,631,541 A 3/1953 Dempsey
2,983,227 A 5/1961 English
3,123,007 A 3/1964 Orr
3,222,994 A 12/1965 English
4,013,385 A 3/1977 Peterson
4,118,154 A 10/1978 Roeder
4,403,919 A 9/1983 Stanton et al.
4,405,291 A 9/1983 Canalizo
4,490,095 A 12/1984 Soderberg
4,551,075 A 11/1985 Canalizo
4,611,974 A 9/1986 Holland
4,616,981 A 10/1986 Simmons et al.
4,861,239 A 8/1989 Simmons et al.
5,494,102 A 2/1996 Schulte
5,785,500 A 7/1998 Leniek
6,131,660 A 10/2000 Stuebinger et al.
6,193,476 B1 2/2001 Sweeney
6,598,681 B1 * 7/2003 Berry ..... E21B 43/128 166/105
6,817,409 B2 11/2004 Howard
7,445,435 B2 11/2008 Howard
7,775,776 B2 8/2010 Bolding
7,874,367 B2 1/2011 Simmons
7,927,083 B2 4/2011 Simmons
7,967,578 B2 6/2011 McNichol et al.
7,984,756 B2 7/2011 Dowling et al.
8,011,901 B2 9/2011 Duncan
8,360,751 B2 1/2013 Duncan
8,454,325 B2 6/2013 Fisher et al.
8,523,542 B2 9/2013 Hofstatter
8,535,017 B2 9/2013 McNichol et al.
8,573,309 B2 11/2013 Simmons
8,932,030 B2 1/2015 McNichol et al.
8,991,504 B2 3/2015 Hansen
10,280,727 B2 5/2019 Saponja et al.
2009/0183870 A1 * 7/2009 Leitch ..... E21B 43/128 166/244.1
2009/0321084 A1 * 12/2009 Simmons ..... F04B 47/02 166/372
2014/0341755 A1 * 11/2014 Laing ..... E21B 47/06 417/53
2015/0267519 A1 9/2015 Saponja et al.
2016/0102536 A1 4/2016 Knoeller
2016/0290111 A1 * 10/2016 Patel ..... E21B 43/121
2018/0283155 A1 10/2018 Saponja et al.
2019/0048695 A1 2/2019 Hansen et al.
2019/0120791 A1 * 4/2019 Al-Gouhi ..... G01N 27/44769
2019/0195059 A1 6/2019 Hrupp

OTHER PUBLICATIONS

HEAL Systems LLP—"HEAL System: Where does the flow go?" www.healsystems.com, 2018, 1 page.
Langbauer, C., et al—"Hydraulic Concentric Tubular Pumping System for Lifting Oil in EOR Completions," SPE-190344-MS, paper prepared for presentation at the SPE-EOR Conference at Oil and Gas West Asia held in Muscat, Oman, Mar. 26-28, 2018, 12 pages.
Petrowiki—"Hydraulic pumping," https://petrowiki.org/Hydraulic_pumping, last modified on Feb. 4, 2016, 16 pages.
Presley, Jennifer—"Selecting the Right Technology is Vital in Horizontal Wells," May 2012 Exclusive Story, The American Oil & Gas Reporter, Feb. 18, 2020, 7 pages.
International Invitation to Pay Additional Fees and, Where Applicable, Protest Fee dated Dec. 4, 2020 for Application No. PCT/US2020/047983.
International Search Report and Written Opinion dated Feb. 2, 2021 for Application No. PCT/US20/47983.

* cited by examiner

DOWNHOLE PUMP AND METHOD FOR PRODUCING WELL FLUIDS

CROSS-REFERENCE TO RELATED APPLICATIONS

This application claims benefit of U.S. provisional patent application Ser. No. 62/893,090, filed Aug. 28, 2019 and U.S. provisional patent application Ser. No. 63/026,548, filed May 18, 2020, both of which are herein incorporated by reference in their entireties.

BACKGROUND

Field of the Invention

Embodiments of the present invention relate to the pumping and recovery of underground liquids and, more particularly, to the utilization of hydraulic principles to facilitate the pumping of liquids without the use of sucker rods.

Description of the Related Art

There is currently a need in the oil industry for a pump that will pump deeper wells, produce more volume and be capable of recovering fluids from diagonal drilling and crooked wells. Current technology fails to solve the problem of lifting water more than 500 feet while being able to use solar and wind applications for a power source. There is also a current problem in certain fields of disposing of unwanted fluids without using extra pumping devices to aid in the process. Embodiments of the present invention are capable of meeting all of the described needs while also being more energy efficient.

In the oil industry currently, the major pump type for deeper wells relies on a pumpjack, which has been used in the industry since early in the 20th century. Earlier technology has also been used fluid to transfer pressures to a pump in a downhole situation.

With the current boom of horizontal drilling, the pumpjack or sucker rod pump is not efficient for this type of drilling. Because of the mechanical connection from the surface to the downhole unit, the pumpjack is locked at the precise distance to be traveled and has a difficult time oscillating rods in horizontal positions or in deviated wells. Embodiments of the present invention have the capability of variation in travel and cycles in each pump, which eliminates rod wear and improves efficiency and reduces wear in the downhill pump.

Current technologies do not have a backflush filtering system, which do not permit the pump to be backflushed, thus creating maintenance problems.

The current technologies also require the entire pump and tubing to be pulled for repairs and do not have the capability of draining the fluid, which therefore creates potential environmental problems when pulling the rods and tubing from the hole.

There is thus a present need for an invention which offers configurations that accommodate industry needs, such as the need for energy efficiency, a less laborious means of horizontal pumping, and the ability to dispose of unwanted fluids from one zone while pumping valuable fluids out of a different zone. There is also a present need for a pump which can lift fluid higher than is currently possible with solar and/or wind powered pumps.

SUMMARY

The present disclosure generally relates to pump designs and methods of using a pump in a wellbore. The present disclosure also relates to methods of using multiple pumps in a wellbore.

Embodiments of the present invention provide a pump that is superior to current fluid lifting technologies, particularly the sucker rod pump. Embodiments of the present invention preferably do not require the use of sucker rods or of a pumpjack on the surface. Embodiments also require less maintenance cost because they can be driven by fluid and the mechanical parts remain centered when they travel; therefore, there is less wear on moving parts, particularly for offset wells.

An embodiment of the present invention can be installed with traditional oil field equipment using a downhole unit comprising tubing, such as approximately 2 to 5 inch (50.8 to 127 mm) tubing, such as approximately 2⅜ inch (60.3 mm) or approximately 2⅞ inch (73.0 mm) tubing. A smaller tube, such as approximately 0.25 to 2 inch (6.4 to 50.8 mm) tubing, such as approximately 1 inch (25.4 mm) or less inside tube diameter, (flex or rigid tubing) is inserted into the larger tubing to create an annulus area for production. The downhole unit uses traditional close tolerance barrels and plungers and has an upward imbalance, which allows the downhole unit to stay at the top of its stroke when it is not oscillating. Unlike the pumpjack, this pumping technology allows the downhole unit to pump a long-slow stroke or a short-fast stroke. Because of the fluid displacement concept, the downhole unit does not require a one-to-one displacement ratio from the surface to the downhole unit.

Embodiments of the present invention improve energy efficiency by about 40 percent from known pumps.

One embodiment of the present invention provides an improved pumping system that saves energy, weighs less, and requires less maintenance than traditional pumping systems.

Another embodiment of the present invention provides a pump system design that pumps from one zone underground while simultaneously disposing of unwanted fluids into a different underground zone.

A further embodiment of the present invention provides a backflush filtering system that prevents traditional filters from clogging, packing off, and starving the pump of fluid.

An embodiment of the present invention preferably comprises a pumping system with no mechanical movement between the surface and the downhole unit in support of the new emerging market of diagonal drilling of wells in order to maximize the efficiency of the production zone.

Another embodiment of the present invention provides a variable volume pumping system that can be adjusted from the surface without shutting off the pump or placing the pump on a timer. The variable volume pump is especially useful for water pumps located in isolated areas of the world.

A further embodiment of the present invention provides a high volume pumping system capable of pumping high volumes with low energy by utilizing both directions of the pump's stroke, thereby increasing efficiency and allowing it to be powered by solar and/or wind energy.

Yet another embodiment of the present invention preferably comprises a method of pulling a dry string (tubing containing no fluid) in the process.

One embodiment of the present invention is preferably a method for removing a production fluid from a well with access to a production zone and access to a disposal zone. The method includes isolating production and disposal zones from one another, forcing a production fluid from the production zone to a production system during a stroke of a plunger, and forcing a disposal fluid into the disposal zone during the same stroke of the plunger. The two zones are isolated using a packer. This embodiment can also include systematically backflushing the production fluid using a screen filter so particulates do not get into the system. The disposal and production rates can also be adjusted. The adjustments are preferably based on the volume of the disposal fluid in the power/disposal fluid tank.

Another embodiment of the present invention is preferably an apparatus for removing a production fluid from a well with access to a production zone and a disposal zone. This apparatus preferably comprises a packer for isolating the production zone from the disposal zone, a plunger that forces the production fluid from the production zone to a production system during a stroke of the plunger. The plunger also forces a disposal fluid into the disposal zone during the same stroke of the plunger.

A further embodiment of the present invention is a method for removing fluid from a well. This method includes disposing a downhole unit at least partially within a well, forcing a plunger of the downhole unit in a first direction and forcing production fluid from a production zone into a production system, and forcing the plunger of the downhole unit in a second direction and forcing production fluid from the production zone into the production system. The plunger of the downhole unit preferably reciprocates causing production of the production fluid on each stroke of the downhole unit.

One embodiment of the present invention comprises a system for removing fluid from a well. This system includes a downhole unit at least partially within a well, a plunger disposed in the downhole unit, wherein the plunger is forced in a first direction thereby forcing production fluid from a production zone into a production system, and the plunger is also forced in a second direction thereby forcing more production fluid from the production zone into the production system. In this embodiment, the plunger preferably reciprocates causing production of production fluid on each stroke of the downhole unit.

Another embodiment of the present invention is a method for moving fluid from a well. This method includes the steps of disposing a downhole unit comprising one or more plungers and a pipe at least partially within the well, applying a power fluid, the power fluid moving the one or more plungers within the downhole unit, forcing a production fluid to a surface of the well, and disposing a valve on or near the downhole unit wherein the valve is releasably activated at or near a surface of the well thereby releasing power fluid contained within the pipe upon removal of the pipe from the well such that power fluid is released through the valve when removing the pipe through the well. The valve in this embodiment is preferably an L-shaped valve. When the pipe is removed from the well, the pipe is preferably a dry pipe. The downhole unit of this embodiment is preferably seated in the well utilizing a seating nipple at the bottom of the downhole unit.

Yet another embodiment of the present invention is an apparatus for moving fluid from a well. The apparatus preferably includes a downhole unit comprising one or more plungers and a pipe at least partially within the well, a power fluid, wherein the power fluid moves one or more plungers within the downhole unit, a production fluid that is moved to a surface of the well, and a valve disposed on or near the downhole unit, wherein the valve releases the power fluid contained within the pipe upon removal of the pipe from the well. The valve of this apparatus preferably comprises an L-shaped valve. When the pipe is removed from the well, it is preferably a dry pipe. A seating nipple is optionally seated at the bottom of the downhole unit.

In another embodiment, a method of producing fluid from a wellbore includes operating a pump located proximate to a zone of fluid influx in the wellbore to draw a fluid from a reservoir into the wellbore at the zone of fluid influx. A first section of a tubing string is coupled to, and extends above, the pump, and a second section of the tubing string is coupled to, and extends below, the pump. A packer seals a first annular space around the first section of the tubing string. The method further includes operating the pump to move the fluid from the second section of the tubing string and into the first section of the tubing string.

In another embodiment, a method of producing fluid from a wellbore includes operating a lower pump in the wellbore to draw a fluid from a reservoir into the wellbore at a lower zone of fluid influx. The method includes operating the lower pump to move the fluid toward an upper pump located in the wellbore, and operating the upper pump to produce the fluid from the wellbore.

In another embodiment, a method of producing fluid from a wellbore includes operating a pump coupled to a tubing string in the wellbore to draw fluid from a reservoir into the wellbore at a first zone of fluid influx and at a second zone of fluid influx. A packer seals an annular space around the tubing string between the first zone of fluid influx and the second zone of fluid influx. The method includes commingling fluid from the first zone of fluid influx and the second zone of fluid influx, and operating the pump to produce the commingled fluid from the wellbore.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The invention may be realized and attained by means of the instrumentalities and combinations particularly pointed out in the appended claims.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

As used throughout the specification and claims, "a" means one or more.

As used throughout the specification and claims, "power pack" means any device, method, apparatus, system or combination thereof which is capable of at least partially providing a pumping action for a fluid.

As used throughout the specification and claims, "pulsar" means any device, method, apparatus, system or combination thereof or the like capable of moving fluid.

As used throughout the specification and claims, pipe and tube are intended to be given a broad meaning and to include any device, method, apparatus, system or combination thereof or the like capable of transporting fluid including but not limited to pipes, tubing, channel, conduit, strings of, combinations thereof and the like made from any material capable of at least temporarily providing a flow path for the fluid including but not limited to metals, composites, synthetics, plastics, combinations thereof, and the like.

As used throughout the specification and claims, "downhole unit" means a device, method, structure, apparatus, system or combination thereof and the like which is disposed at least partially within a hole.

As used throughout the specification and claims, "plunger" means a device, method, structure, apparatus, system or combination thereof capable of pressurizing a fluid.

As used throughout the specification and claims, "sequence system" means a device, method, structure, apparatus, system or combination thereof capable of activating a pulsar, including but not limited to a pressure sensor or a series of pressure sensors.

As used throughout the specification and claims, "production system" means a device, method, structure, apparatus, system or combination thereof capable of storing or further processing production fluid including but not limited to a tank, a surface, a pipe, a heat exchanger, a pump and combinations thereof.

As used throughout the specification and claims, "packer" is intended to be given a broad meaning and to include any device, method, apparatus, structure, system or combination thereof capable of isolating or separating one zone in a hole from another zone in a hole. For example, a packer can isolate a production zone from a disposal zone in a well.

Closed System

Figure 1:
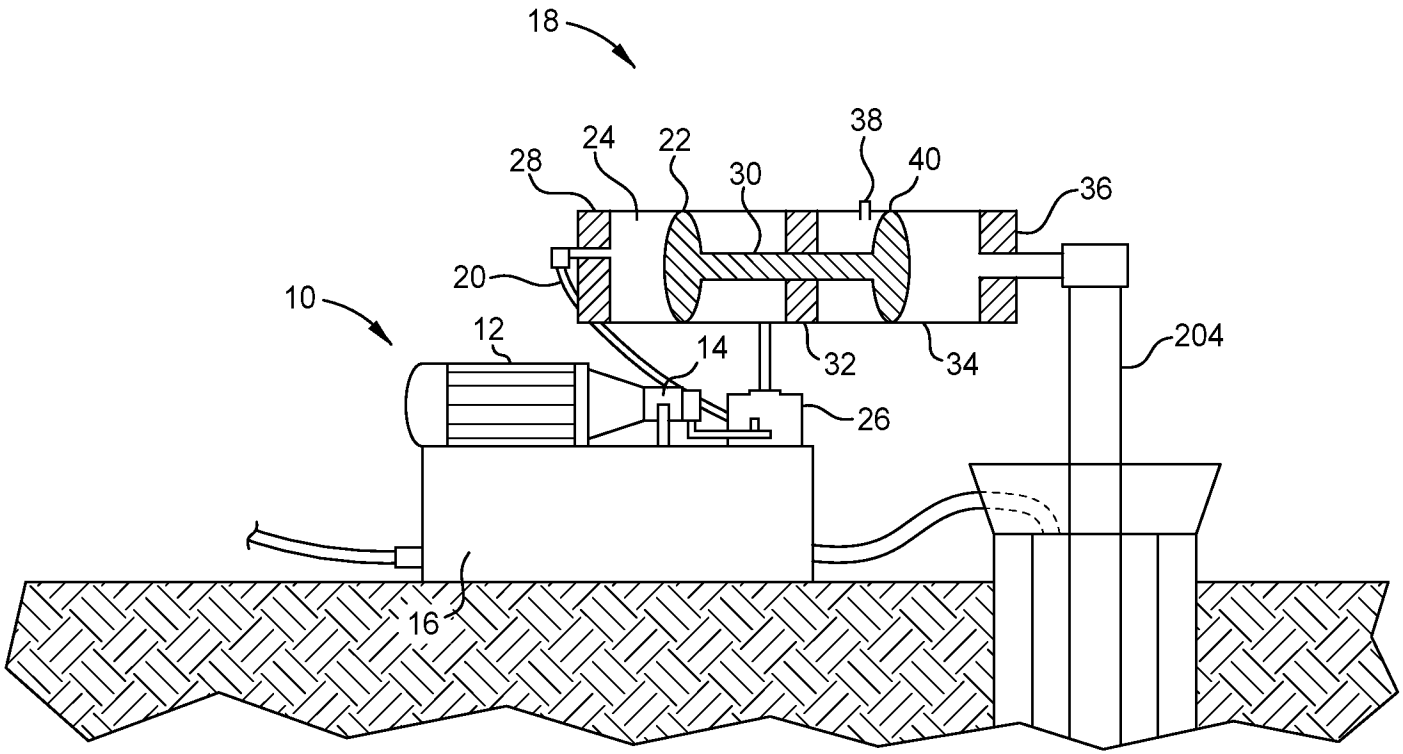
FIG. 1 is a side view schematic drawing illustrating an embodiment of the present invention wherein a pulsar unit is connected to a single well, which unit displaces fluid on the surface and forces a downhole unit to travel downward.

Referring to FIG. 1, power pack 10 on the surface is preferably a closed system of hydraulic fluid. The hydraulic fluid is used to transfer power from hydraulic pump 14 to pulsar 18, both of which are preferably at or near the surface of a well. In a preferred embodiment, the hydraulic fluid does not co-mingle with a power fluid. The power fluid transfers energy from pulsar 18 and provides downward pressure on downhole unit 200 (see FIG. 2). In this embodiment, the hydraulic fluid also preferably does not co-mingle with a production fluid. The production fluid is the product that is pumped to the surface from an underground formation using embodiments of the present invention. The power fluid is also preferably a closed system. The power fluid actually forces the movement of downhole unit 200, and in one embodiment, is made up mostly of water. Since water is virtually non-compressible, the pressure is transferred immediately to downhole unit 200 with a very high efficiency and very little compression. If any unanticipated fluid loss occurs, power fluid piston 40 creates a vacuum as it returns to a reset position and thus fills any void of fluid in power tube 204.

FIG. 1 illustrates an embodiment of the present invention comprising power pack 10 and pulsar unit 18 that displaces fluid on the surface and forces downhole unit 200 to reciprocate.

Figure 2:
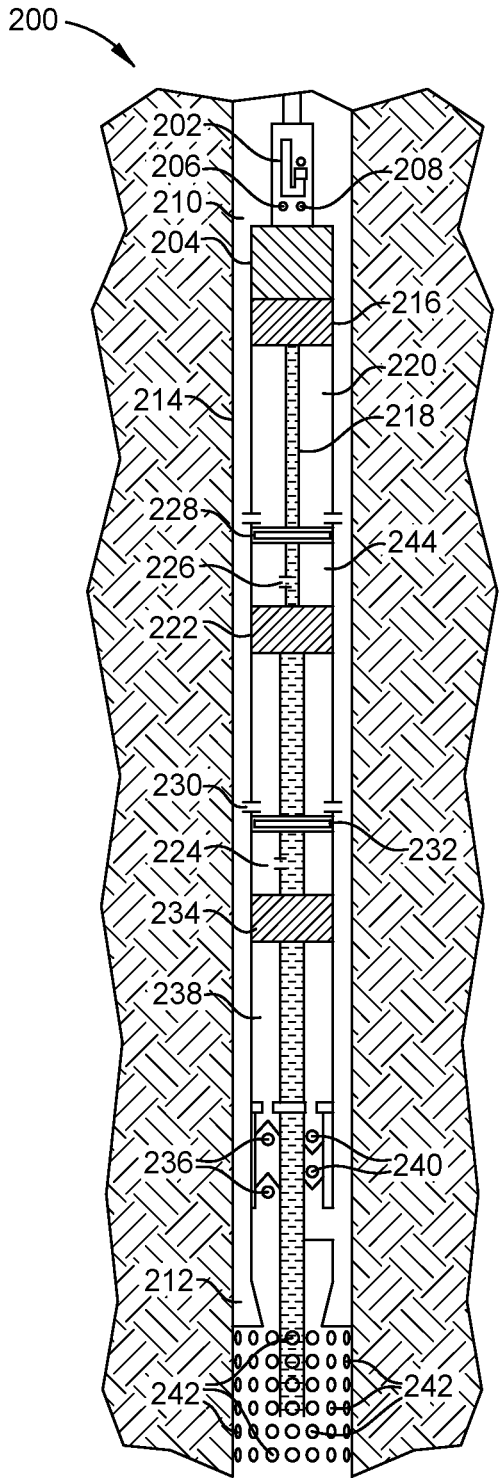
FIG. 2 is a side view schematic drawing illustrating an embodiment of the present invention wherein a pulsar unit forces a downhole unit in each of a plurality of wells to travel downward on opposite strokes of a piston in the pulsar unit.

FIG. 1 illustrates power pack 10 preferably comprising motor 12, preferably a standard electric motor. Motor 12 can be a typical alternating current (AC) or direct current (DC) motor, which allows for the application of a solar or wind or manual power source. Motor 12 is fastened to hydraulic pump 14, which is supported by reservoir tank 16. Reservoir tank 16 is filled with hydraulic fluid and provides the fluid drive for pulsar unit 18. Pulsar unit 18 is preferably a closed system, thus the hydraulic fluid does not commingle with power fluid or production fluid. Line 20 is fastened to reservoir tank 16 and moves hydraulic fluid from reservoir tank 16 to hydraulic cylinder 24 which is sealed using end cap 28. Hydraulic piston 22 is housed in hydraulic cylinder 24. Reservoir tank 16 and hydraulic cylinder 24 can be made of any suitable material capable of holding hydraulic fluid and operating under required high pressures. Hydraulic valving system 26 activates pulsar 18 which oscillates and cycles connecting shaft 30 back and forth. Valving system 26 is preferably controlled by the various pressures in the closed power system and is activated by a spiked pressure from downhole unit 200. As illustrated in FIG. 2, downhole unit 200 preferably travels its complete length, until bottom plunger 234 bottoms out, thus increasing pressure in power tube 204. The spike in pressure then trips a sequence system. The sequence system then initiates the flow of hydraulic fluid through hydraulic valving system 26 and reverses the direction of hydraulic piston 22 on the surface. The sequence system can be electrical, mechanical, or a combination thereof.

Motor 12 preferably provides the power that drives hydraulic pump 14, which pumps hydraulic fluid into hydraulic cylinder 24 which then transfers pressure to hydraulic piston 22. Hydraulic piston 22 preferably moves and transfers power through connecting shaft 30. Shaft 30 moves through center coupling 32. Center coupling 32 is preferably sealed off with a seal-pack made of any suitable material designed to maintain pressure differentials between the two areas. Connecting shaft 30 is preferably fastened to both power fluid cylinder 34 and hydraulic cylinder 24. Connecting shaft 30 preferably activates and as hydraulic piston 22 begins to move toward power fluid cylinder 34, it builds pressure in power tube 204. End cap 36 for the power fluid prevents the pressure in power fluid cylinder 34 from pushing backward towards hydraulic cylinder 24 and thereby forces all of the pressure to be concentrated in the downward direction. Vent 38 allows power fluid cylinder 34 to vent in and out and prevents power fluid piston 40 from locking up as power tube 204 begins to build pressure. The pressure is transferred to downhole unit 200 and applied to top plunger 216 (see FIG. 2) begins to move downward in the well. As plungers 216, 222, and 234 are forced downward, that pressure forces production fluid to move up annulus area 210 and into a closed shell in reservoir tank 16. The production fluid can then be used as a cooling device for the hydraulic fluid, located in a second shell in reservoir tank 16 thereby cooling the hydraulic fluid. The production fluid is also warmed by the hydraulic fluid making the production fluid easier to process and separate downstream. Hydraulic fluid and production fluid are preferably isolated from one another in reservoir tank 16. The production fluid preferably moves through reservoir tank 16 and into a storage tank (not shown).

FIG. 2 illustrates an embodiment of the present invention comprising downhole unit 200 that is connected to pulsar unit 18 (see FIG. 1).

In one embodiment of the present invention, as illustrated in FIG. 2, relief valve 202 is preferably an L-shaped valve and is installed in power tube 204 between the top of downhole unit 200 and the beginning of power tube 204. Relief valve 202 allows power fluid to drain from power tube 204 as downhole unit 200 is being pulled to the surface, for example, in case of needed repairs. Relief valve 202 allows a repair crew to pull a dry string, a pipe that does not contain fluid, rather than a wet string. The ability to pull a dry string prevents spillage of power fluid onto a surface. Preferably, relief valve 202 is initially seated closed, then it is twisted and power tube 204 is then slid up and pulls power tube 204 up and out of the hole. When power tube 204 is being pulled up, it passes vents 206 and 208 which drains the power fluid, thus pulling up a "dry" string. In one embodiment, when removing a pipe, a repair crew does not pull a wet string.

Annulus area 210 is the area through which the production fluid travels up to the surface. Downhole unit 200 is preferably seated with seating nipple 212 at the bottom of downhole unit 200. Seating nipple 212 can also be installed at the top of downhole unit 200, thus suspending downhole unit 200 from seating nipple 212. Annulus area 210 comprises the area between power tube 204 and outside tubing 214. As downhole unit 200 is seated, the production fluid remains in annulus area 210, or, if downhole unit 200 is unseated, the production fluid is released to the formation.

Downhole unit 200 preferably receives pressure from pulsar unit 18 on top plunger 216. When pressure is applied to top plunger 216, it moves downward, as does connecting shaft 218 and plungers 222 and 234. Plunger 216 is preferably held in place by cylinder 220. The pressure on top plunger 216 is converted to force and activates plunger 222. Plunger 222 is preferably for counterbalance pressure. Downhole unit 200 creates an upward force greater than a downward force when downhole unit 200 is static, because formation area 224 has less pressure than downhole unit 200, it creates an upward imbalance on downhole unit 200. Therefore, the only energy required from the surface is enough to move plungers 216, 222 and 234 downward. The top of plunger 222 is preferably exposed to the formation through vent 226. Coupling 228 seals off cylinder 220, thereby creating a pressure differential at the top of plunger 222. While the top of plunger 222 is exposed to the formation, the bottom of plunger 222 is exposed to annulus area 210 via vent opening 230, which creates an upward pressure using coupling 232 to separate fluid pressures. Coupling 232 is designed to prevent pressures from equalizing in area 224 which is exposed to the formation. The top of plunger 234 is exposed to the formation and the bottom of plunger 234 is exposed to production fluid and is utilized to move production fluid out of valving 236 and up annulus area 210. Production fluid preferably moves into and out of production chamber 238. Valving 236 preferably comprises one-way check valves between chamber 238 and annulus area 210, wherein production fluid preferably travels from chamber 238 to annulus area 210. Valving 240 also comprises one-way check valves that prevent the production fluid that is in chamber 238 from returning back to the formation. As downhole unit 200 moves down, the downward pressure forces valving 236 to open thereby sending production fluid up annulus area 210. As downhole unit 200 moves back up, the upward force opens valving 240 to accept production fluid into chamber 238 from the formation after the fluid is filtered via filter system 242.

Filter system 242, preferably comprises a mesh screen filter installed on the bottom of downhole unit 200. Filter system 242 does not clog since the upper chambers of downhole unit 200 are vented to the formation. This venting allows fluid to oscillate in and out of downhole unit 200. Downward pressure from downhole unit 200 creates an outward force of fluid from chamber 238, blowing away any debris that may collect around the filter and preventing the flow of unfiltered fluid in upper chambers 224 and 244 from entering downhole unit 200.

Multiple Wells

Figure 3:
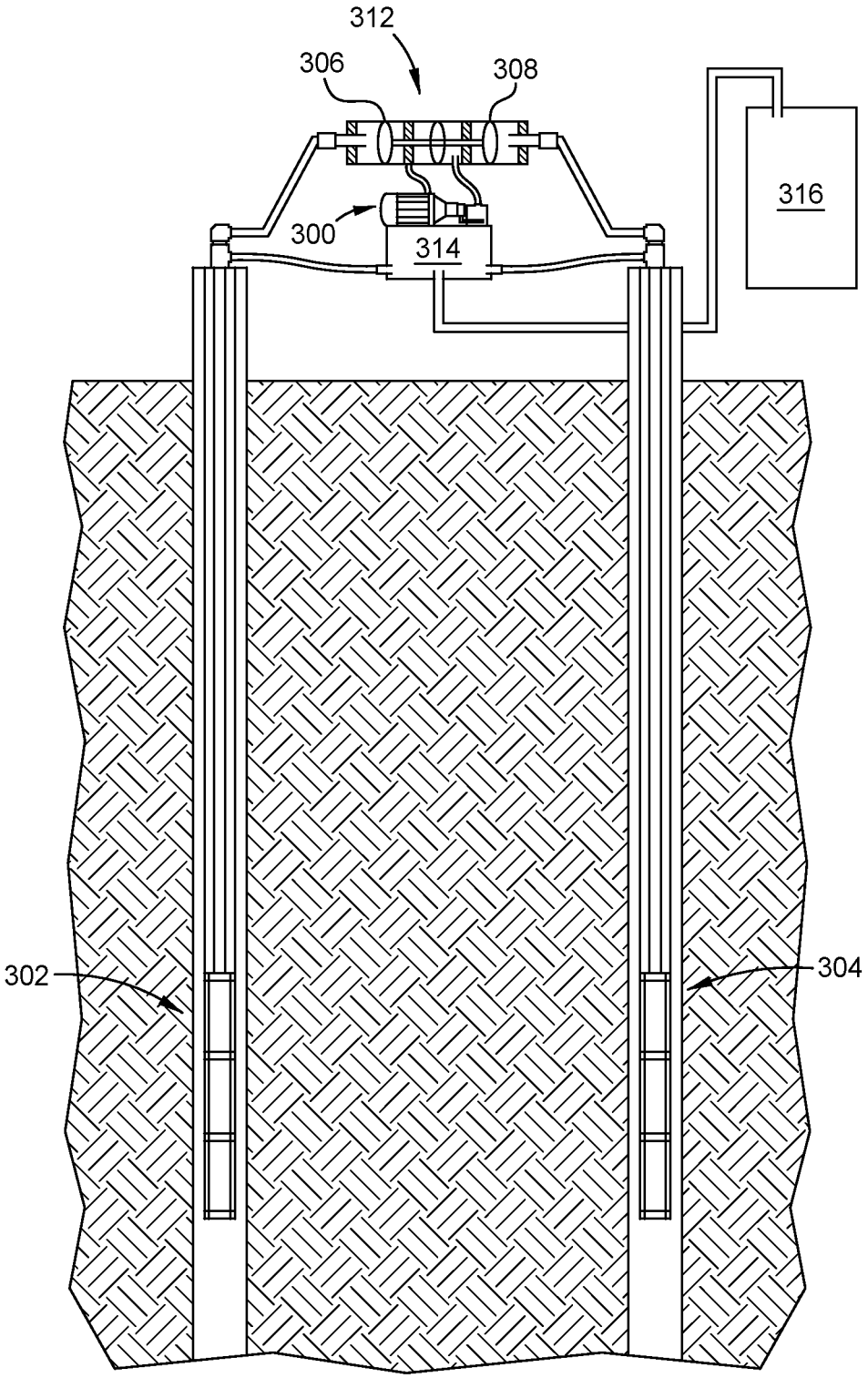
FIG. 3 is a cross sectional view schematic drawing illustrating a downhole pump according to an embodiment of the present invention.

Referring to FIG. 3, one embodiment of the present invention comprises power pack 300 and pulsar 312. Downhole units 302 and 304 preferably operate with only one surface unit, namely power pack 300 and pulsar 302, thus further improving the efficiency of pulsar 312. In one configuration, when utilizing power pack 300, pulsar 312 can be used to pump two wells or more. In this embodiment, pistons 306 and 308 oscillate back and forth thereby recovering production fluid on the down stroke of both downhole units 302 and 304. The production fluid is then used to cool the hydraulic fluid in reservoir tank 314 and at the same time the production fluid is warmed for easier separation of oil and water in the production fluid before it is sent to tank 316.

Isolated Disposal Zone

Figure 4:
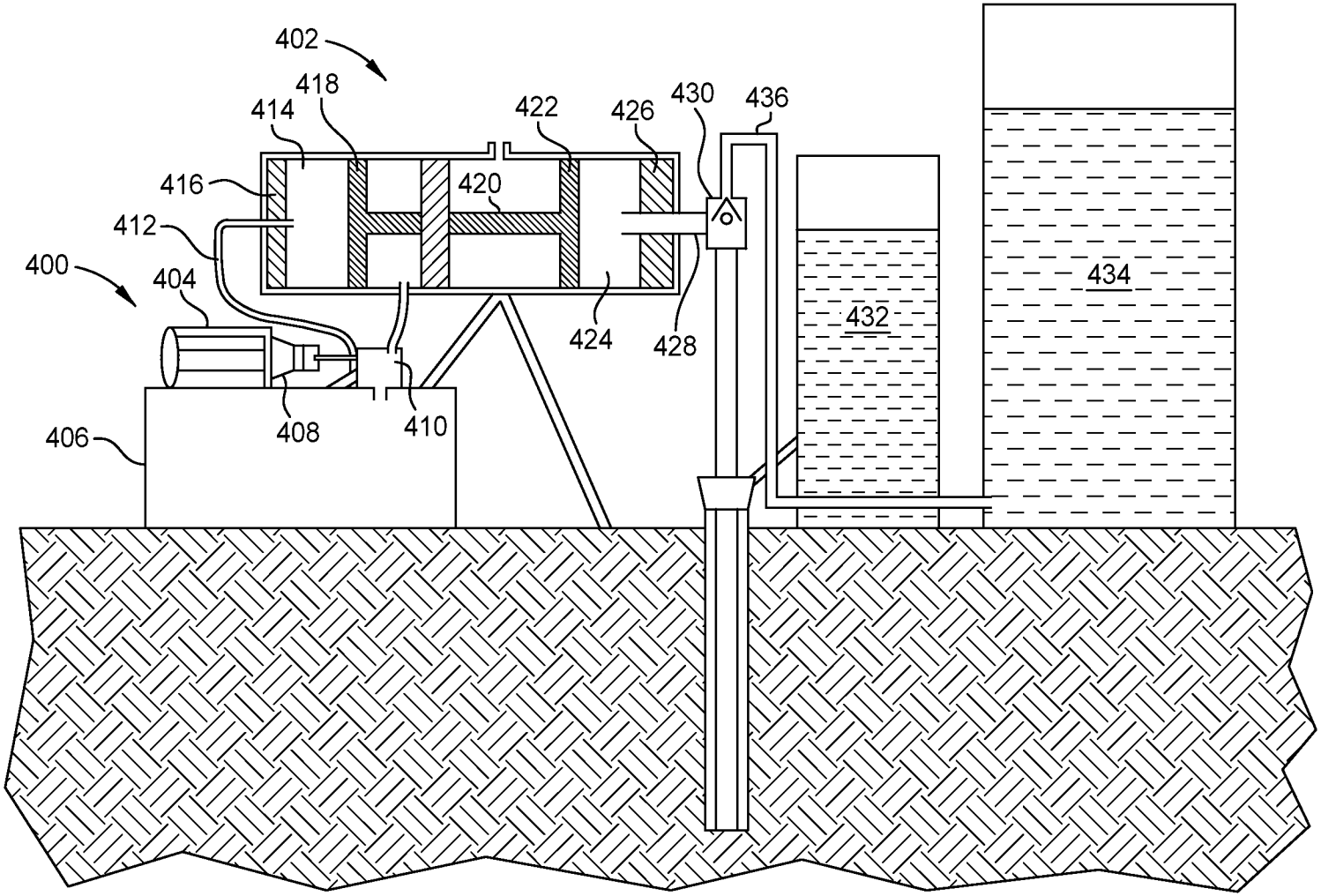
FIG. 4 is a side view schematic drawing illustrating a pulsar and power pack unit for production/disposal of fluids according to an embodiment of the present invention.
Figure 5A:
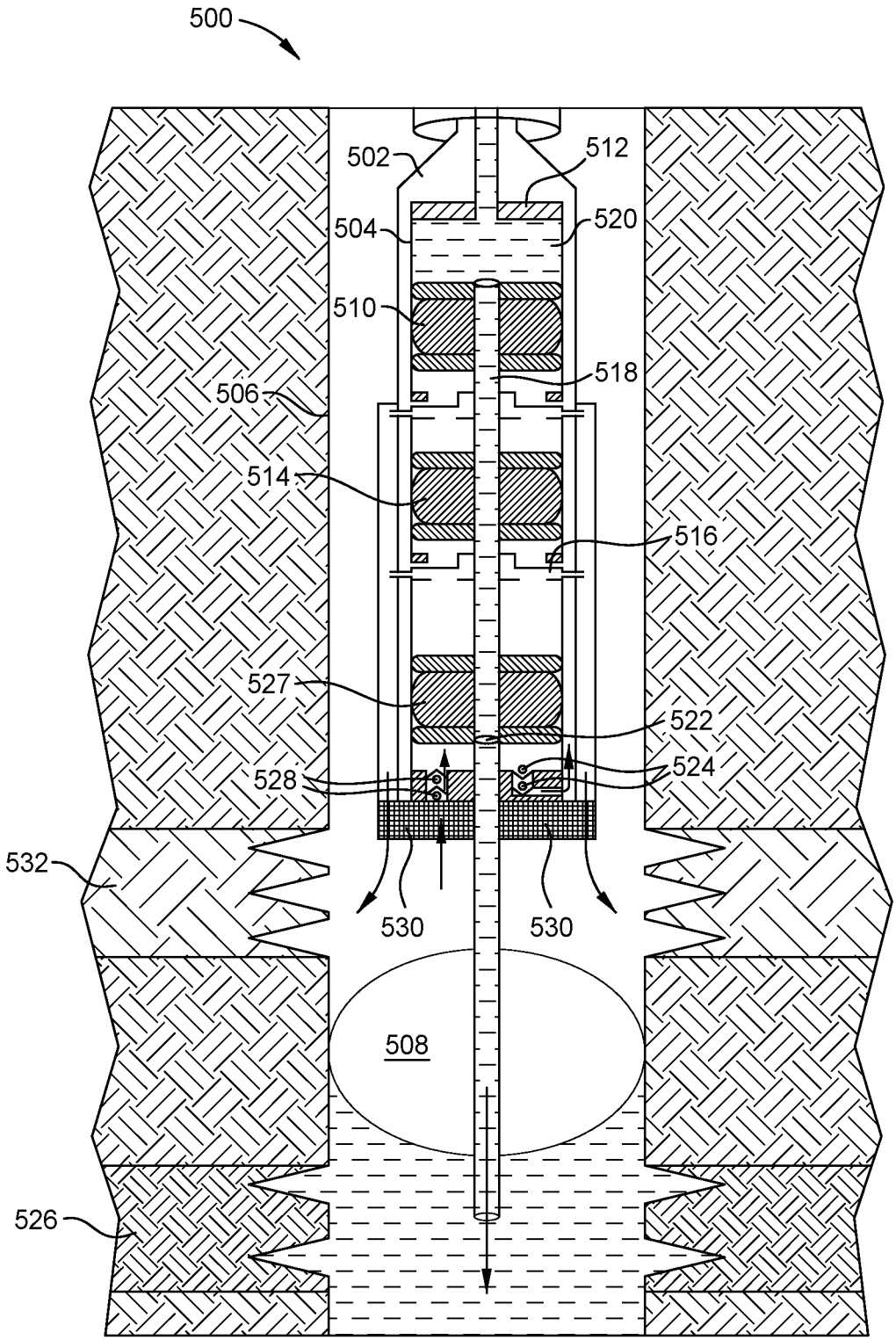
FIG. 5A is a section view schematic drawing illustrating a production/disposal downhole unit with a disposal zone located below a production zone according to an embodiment of the present invention.
Figure 5B:
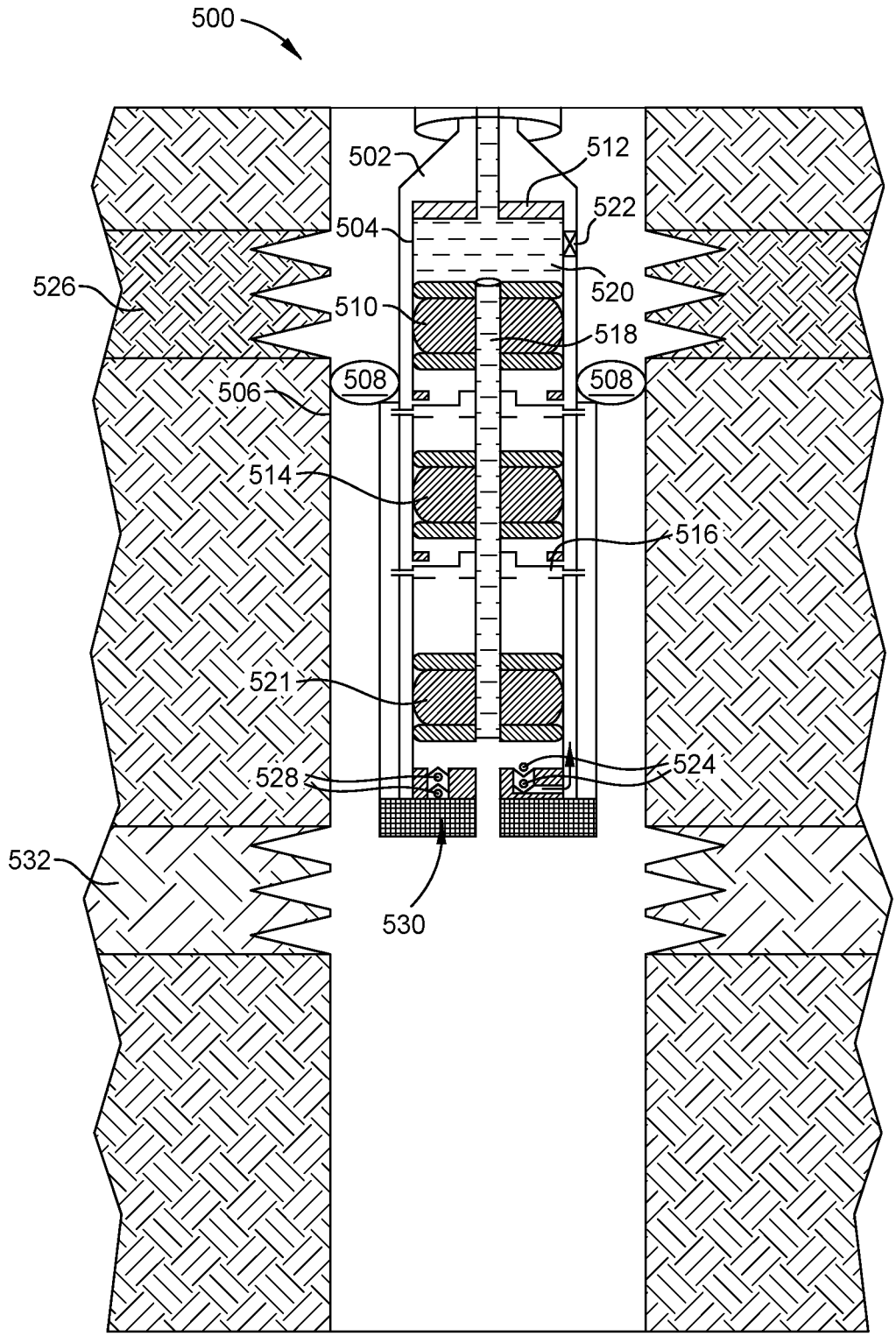
FIG. 5B is a section view schematic drawing illustrating a production/disposal downhole unit with a disposal zone located above a production zone according to another embodiment of the present invention.

Referring to FIGS. 4 and 5A-5B, another embodiment of the present invention comprises pulsar 402 and downhole unit 500 that allows recovery of production of fluid from one zone in a well and at the same time has the capability of disposing unwanted fluid in a second zone in the well. In this embodiment, once plunger 527 bottoms out, the pressure spikes in power tube 504, opening pressure relief valve 522 and forcing unwanted power fluid through packer 508 into an isolated zone suitable for disposing the unwanted fluid. When all of the unwanted fluid is disposed into disposal zone 526, power fluid piston 422 will butt up against end cap 426 creating an additional spike in pressure, which triggers a sequence system to reverse pulsar 420 and pull in additional power fluid by opening valve 430 for the next cycle. Pulsar 402 has two levels of operating pressure and provides two different functions, one pressure level for recovering production fluid from a formation and the other pressure level for disposing of unwanted fluid.

FIG. 4 illustrates an embodiment of the present invention comprising power pack 400 and pulsar 402 for recovery of underground liquids.

This embodiment preferably utilizes two areas of a well in a downhole situation by pumping production fluid out of one zone of a formation and at the same time disposing unwanted fluid into a second zone of a formation.

Power pack 400 and pulsar 402 preferably comprises motor 404. Motor 404 is preferably a standard weatherproof AC or DC power supply. Power pack 400 preferably includes reservoir 406, which preferably comprises hydraulic fluid. Reservoir 406 can be made out of any suitable material capable of holding hydraulic fluid. Reservoir 406 has relatively low pressure and can be built with an extra chamber to allow the production fluid to flow through, thereby creating a heat exchanger for cooling the hydraulic fluid. In this embodiment, motor 404 generates power and transfers that power to hydraulic pump 408. Hydraulic fluid is pumped via hydraulic pump 408 to unit 410, and generates high pressure as it is passed through high pressure hydraulic line 412. Line 412 can be made of any material capable of handling high pressures. Line 412 supplies hydraulic fluid to hydraulic cylinder 414 which is supported by end cap 416. The hydraulic fluid pushes against hydraulic piston 418, which oscillates back and forth. Hydraulic piston 418 is preferably installed with a close tolerance clearance and is attached to connecting shaft 420. Hydraulic piston 418 moves toward connecting shaft 420, which then transfers power to power fluid piston 422. This action creates pressure on power fluid cylinder 424 which is held in place by end cap 426 until the power fluid/deposal fluid is released through outlet 428.

One-way check valve 430 is preferably forced open to replace power fluid in power fluid cylinder 424 in the case of any unanticipated loss of power fluid during the backstroke of pulsar 402, as pulsar 402 is moving back toward hydraulic cylinder 414 to the reset position. Any void of power fluid could create a vacuum, which would allow one-way check valve 430 to open, thereby assuring that the down stroke of pulsar 402 has full unitization of power fluid to make sure downhole unit 500 travels the full distance that it is designed to travel, namely to bottom out.

As power fluid piston 422 oscillates toward end cap 426, production fluid travels up an annulus area into production tank 432. The power/disposal fluid is separated from the production fluid and placed in tank 434 and is reused through line 436 to fill power fluid cylinder 424 in order to start another cycle. In this embodiment, the power/disposal fluid is used to activate downhole unit 500. Downhole unit 500 preferably lifts the production fluid to the surface and also disposes of unwanted fluid in a disposal zone. The disposal zone can be above or below a production zone. FIG. 5A illustrates an embodiment of the present invention with the disposal zone located below the production zone. FIG. 5B illustrates an embodiment of the present invention with the disposal zone located above the production zone.

By adjusting the reciprocation set points for pistons 418 and 422, the volumetric displacement of disposal fluid removed from tank 434 in relationship to the amount of production fluid entering tank 432 can be adjusted such that an optimized production/disposal rate is produced. This adjustment permits more disposal fluid to be disposed in the disposal zone as tank 434 nears its capacity limit. Alternatively, as tank 434 nears an empty state, the rate of fluid disposal can be lessened. Those skilled in the art will readily appreciate numerous manners for such reciprocation set points including electronic sensors and/or physical alterations to connecting shaft 420, pistons 418 and/or 422 as well as caps 416 and 426. In one embodiment, an electronic circuit is preferably provided which adjusts the reciprocation points based on fluid levels of tank 434 and/or tank 432 or alternatively based on some other measurement or user-specified criteria.

FIGS. 5A and 5B illustrate embodiments of the present invention comprising dual purpose production/disposal downhole unit 500 that works in conjunction with pulsar 402 and power pack 400 in FIG. 4. Downhole unit 500 preferably pumps production fluids from one zone of a formation to tank 432 and disposes of unwanted fluids in another zone of a formation on the same stroke of pulsar 402.

In one embodiment of the present invention, the production fluid is transferred to the surface through annulus area 502, which is the area between power tube 504 and production pipe 506. Power tube 504 preferably comprises an approximately 0.5 to 5 inch (12.7 to 127 mm) tube and more preferably approximately 0.75 to 3 inch (19.1 to 76.2 mm) tube and most preferably approximately a 1 inch (25.4 mm) tube and production pipe 506 preferably comprises an approximately 0.5 to 5 inch (12.7 to 127 mm) pipe and more preferably a 2 to 4 inch (50.8 to 101.6 mm) pipe and most preferably an approximately 2⅞ inch (73.0 mm) pipe. Downhole unit 500 is preferably set in a hole with packer 508. Standard equipment can be used to provide separation of a production zone and a disposal zone. Downhole unit 500 is preferably installed with tubing capable of transferring fluid under the desired pressures.

Disposal/power fluid chamber 520 is preferably a closed system that transfers pressure from the surface to the top of plunger 510. Top coupling 512 preferably maintains the separation of pressures. The bottom of plunger 510 is exposed to annulus area 502. The production fluid in annulus area 502 creates the upward force on plungers 510 and 514.

The area under plunger 514 separates the pressures and fluids between plungers 514 and 527 with coupling 516. Vent 518 comprises power/disposal fluid and serves as the connecting rod to plungers 510, 514 and 527. High pressure relief valve 522 is installed at the bottom of vent 518 for the disposal of disposal/power fluid, and does not open unless the pressure in downhole unit 500 exceeds normal operating production pressures, at which time high pressure relief valve 522 opens and forces excess disposal fluid into the disposal area through packer 508.

In an embodiment of the present invention, the disposal/power fluid exerts downward pressure on plunger 510 causing plungers 510, 514 and 521 to travel downward. This downward pressure forces production fluid into annulus area 502 through check valve 524. When plungers 510, 514 and 527 have reached the bottom of a desired distance, plungers 510, 514 and 527 bottom out and pressure builds in downhole unit 500 until the downward pressure from the disposal/ power fluid exceeds the production operating pressure. At that point, high pressure relief valve 522 opens and deposits the unwanted fluid in disposal area 526 through packer 508. The opening of high pressure relief valve 522 trips a sequence system and power fluid piston 422 (FIG. 4) moves toward hydraulic piston 418 thereby moving plungers 510, 514, and 527 in an upward direction. One-way check valve 528 takes in production fluid on each oscillation of downhole unit 500. Check valve 524 for outlet is on the opposite side of the tubing and forces the production fluid up annulus area 502. Attached to valving system 528 is screen filter 530, which is capable of keeping debris from entering downhole unit 500. As illustrated in FIGS. 5A and 5B, downhole unit 500 can be installed with disposal area 526 either above or below production zone 532.

Figure 6:
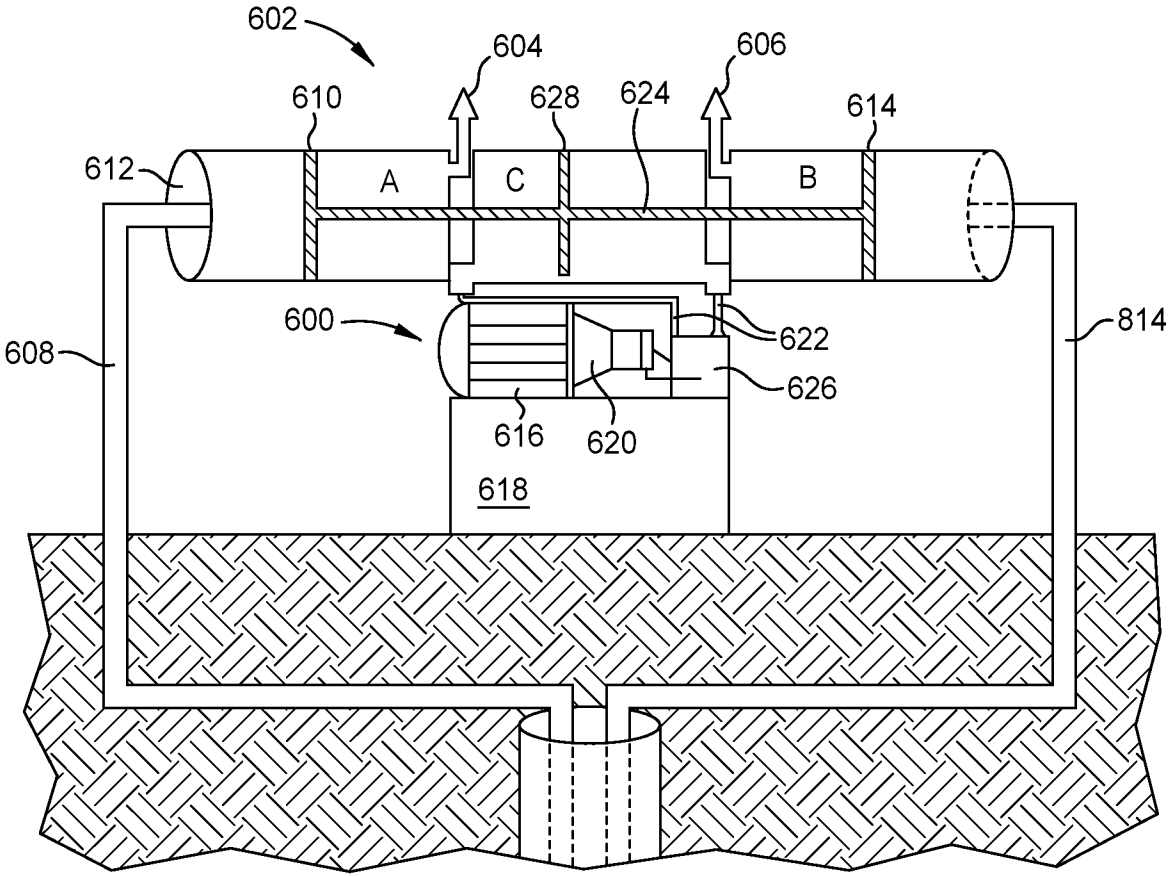
FIG. 6 is a cross sectional view schematic drawing illustrating a pulsar unit that utilizes commingled fluid and a power pack unit that releases excess fluid through a new slip piston design according to an embodiment of the present invention.
Figure 7:
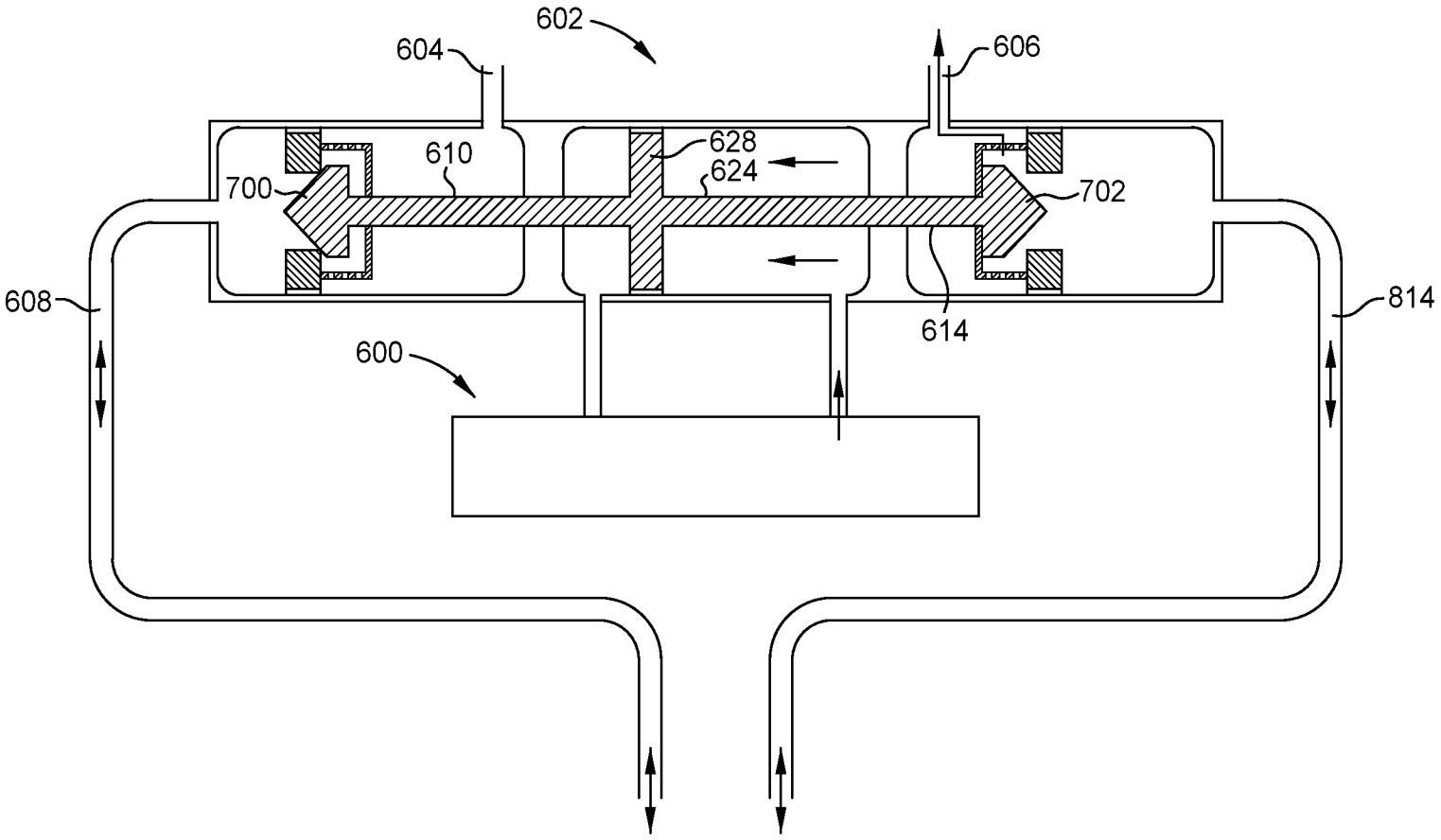
FIG. 7 illustrates an exploded view schematic drawing illustrating of the pulsar unit illustrated in FIG. 6.

FIG. 6 illustrates an embodiment of the present invention comprising power pack 600 and pulsar 602 which preferably commingles power and production fluids and releases fluids through relief valves 604 and 606. FIG. 7 illustrates a blown-up illustration of pulsar 602.

This embodiment of the present invention comprises power pack 600 on the surface with pulsar 602 equipped to commingle production fluids and power fluids. Power pack 600 preferably comprises an electrical motor for power supply 616, which can be a DC motor or an AC motor adaptable for solar or wind energy or manual operation. Alternatively, power pack 600 can run solely on solar or wind energy power supply. The motor is preferably mounted on hydraulic fuel tank 618 and connected to hydraulic pump 620. Hydraulic power line 622 is connected to sequence system 626 and is used to transfer power to chamber C in order to oscillate pistons 628, 610 and 614 in pulsar 602. Pulsar 602 preferably comprises three separate chambers of fluid (A, B and C), one of which (chamber C) is hydraulic fluid in preferably a totally closed system. Hydraulic fluid is preferably removed from tank 618 via hydraulic pump 620 and forced into Chamber C forcing piston 628 in a direction towards Chamber B and causing piston 614 to force fluid disposed within Chamber B down pipe 814. The fluid then forces plunger 810 (see FIG. 8) up causing production fluid within chamber 811 of downhole unit 800 to be forced up vent tube 808 through valve 804 and up pipe 608. Once chamber 811 is closed off and plunger 810 butts up against coupling 812, a pressure spike occurs on side B and sequence system 626 activates piston 628 to move connecting shaft 624 and pistons 610, 614, and 628 toward chamber A thereby sending production fluid down side A and sending excess fluid up and out chamber B via valve 606 by opening cone valve 702 disposed on piston 614.

After the excess fluid is released through valve 606 and plungers 806 and 810 bottom out, another pressure spike occurs and sequence system 626 reverses direction and connecting shaft 624 then moves toward pipe 814 and closes cone valve 702. Cone valve 702 is preferably closed using a stop, seat, latch, combination thereof or the like that is disposed on piston 614. Cone valve 702 can optionally be closed using a stop, seat, latch, combination thereof or the like that is located in chamber B. The pressure from moving piston 614 toward pipe 814 forces fluid down pipe 814 and forces plungers 806 and 810 upward which forces fluid from chamber 811 up vent tube 808, through valve 804 and up pipe 608. When the excess fluid enters chamber A from pipe 608, cone valve 700 opens and releases excess fluid out valve 604. When all the excess fluid is released through valve 604 and when chamber 811 is closed off, another pressure spike occurs and sequence system 626 forces a directional change of piston 628. Piston 628 then pushes piston 610 toward pipe 614 and closes cone valve 700. Cone valve 700 is preferably closed using a stop, seat, latch, combination thereof or the like that is disposed on piston 610. Cone valve 700 can optionally be closed using a stop, seat, latch, combination thereof or the like that is located in chamber B. This cycle is repeated with each oscillation of pulsar 602. This process continues to cycle as the same fluid is used to activate downhole unit 800 and has the capability of relieving the excess fluid on the upstroke of each cycle.

Figure 8:
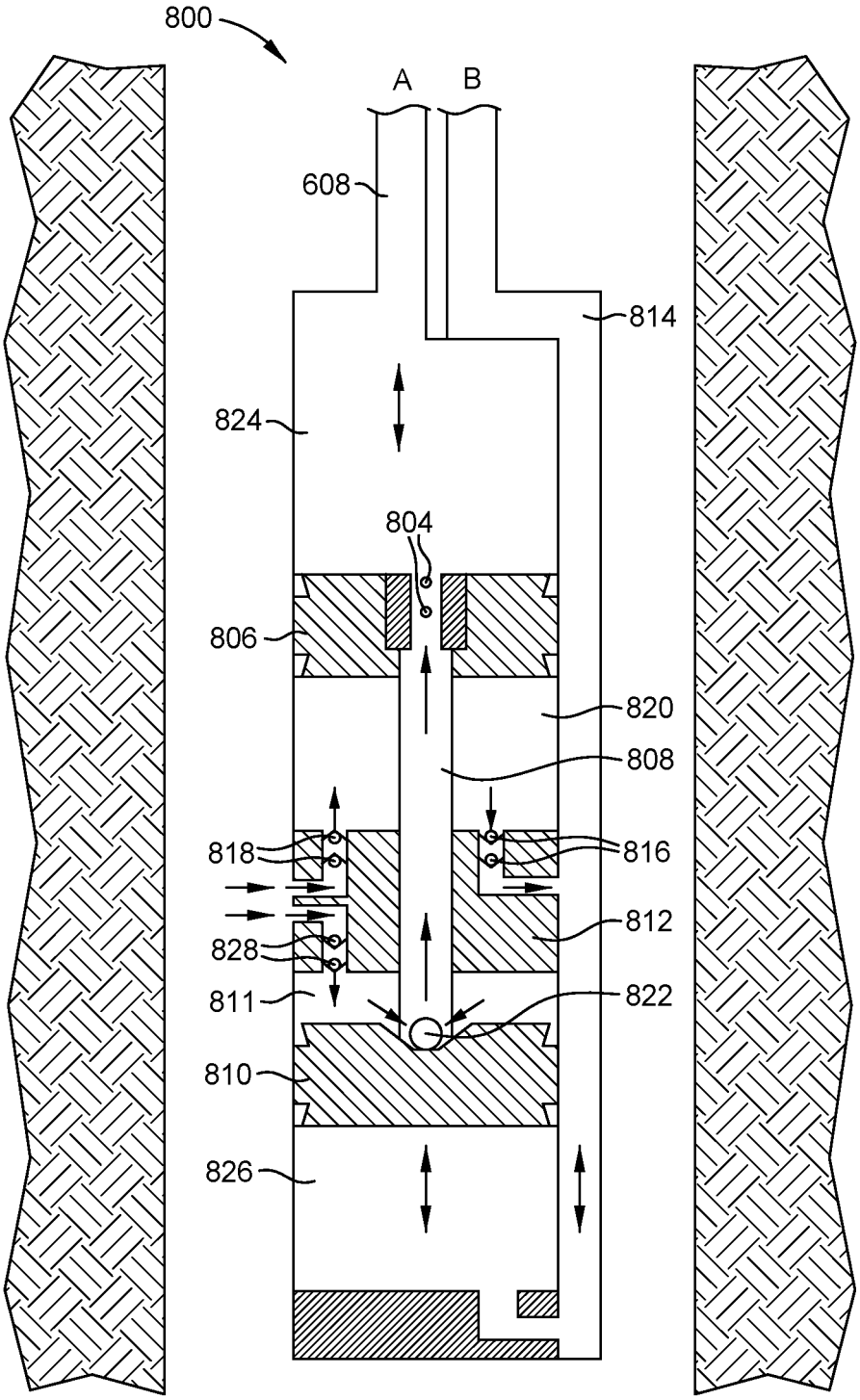
FIG. 8 is a section view schematic drawing illustrating a downhole dual production pumping unit according to an embodiment of the present invention.

Referring to FIGS. 6-8, this embodiment of the present invention can be used for shallow wells and can use either rigid or flexible lines to transfer pressures and production. This embodiment can also be installed as a portable or permanent installation. In one embodiment of the present invention, pulsar 602 is preferably approximately 3 to 20 inches (76.2 to 508 mm) in diameter and more preferably approximately 5 to 15 inches (127 to 381 mm) in diameter and most preferably approximately 7 to 10 inches (177.8 to 254 mm) in diameter. Pistons 610 and 614 are preferably installed with a close tolerance clearance with pulsar 602, thus the diameter of pistons 610 and 614 are preferably close to the diameter of pulsar 602. Cone valves 700 and 702 are preferably approximately 0.5 to 4 inches (12.7 to 101.6 mm) in diameter and more preferably approximately 1 to 3 inches (25.4 to 76.2 mm) in diameter. Thus, excess fluid is preferably pushed out of the relatively small diameters of cone valves 700 and 702 that are disposed on the larger diameter pistons 610 and 614. If downhole unit 800 is installed with flexible lines, it is preferred that a small cable be attached to downhole unit 800 and intertwined with the two lines to give the tensile strength needed during removal of downhole unit 800.

FIG. 8 illustrates an embodiment of the present invention comprising downhole unit 800 capable of recovering fluid from both sides of its stroke. FIG. 8 is a continuation of the pump assembly illustrated in FIGS. 6-7. FIG. 8 shows the lower section of the assembly. Downhole unit 800 in this embodiment is capable of producing fluid on each side of its stroke, referred to as Side A and Side B. As Side A pipe 608 receives pressure from fluid on the surface, the fluid forces check valve 804 closed, plungers 806 and 810 move down pushing fluid out of chamber 820 through valve 816 and up pipe 814 on side B and also pushes fluid out of chamber 826 and at the same time fills chamber 811 through side A valve 828.

When plungers 806 and 810 bottom out, a spike in pressure occurs in chamber A which activates sequence system 626 that then sends hydraulic fluid into chamber C and moves connecting shaft 624 and pistons 610, 614, and 628 toward side B which pushes fluid down pipe 814 and moves plungers 810 and 806 up until plunger 810 butts up against coupling 812. As piston 614 moves towards pipe 814, cone valve 700 disposed on piston 610, opens allowing the excess fluid in chamber A to escape through valve 604. When all of the excess fluid is released through valve 604 and when chamber 811 is closed off, a pressure spike occurs on side B and sequence system 626 is activated and forces piston 628 to move toward side A which then closes cone valve 700 and forces fluid down pipe 608. The fluid forces plungers 806 and 810 to move downward and fluid from chamber 820 is forced up side B pipe 814. As fluid is forced down side A and forced up side B, cone valve 702 disposed on piston 614 opens and the excess fluid is released through valve 606. When plungers 806 and 810 bottom out and all the excess fluid is released through valve 606, there is a pressure spike on side A that triggers sequence system 626 which activates plunger 628 to move toward side B.

This embodiment creates two production areas, chambers 820 and 811. When downward pressure forces plunger 806 down, valve 816 sends fluid from chamber 820 up side B pipe 814. As upward pressure forces plunger 806 to move up, chamber 820 fills back up with production fluid through valve 818. When downward pressure forces plunger 810 down, chamber 811 fills with production fluid via valve 828. When upward pressure forces plunger 810 to move up, production fluid in chamber 811 moves up vent tube 808 through valve 804 and into side A pipe 608. At the same time, chamber 820 is being filled with production fluid via valve 818. Production fluid commingles with side A production/power fluid, which allows the fluid to escape through plunger 806. This process cycles and continues to oscillate and thereby creates production. As plungers 806 and 810 move, a vacuum is created, which opens production chamber 820 and pulls in additional production fluid. Within the same stroke, the bottom of plunger 806 forces stored fluid out check valve 816 and up through power/production tube 814. This process allows for efficient pumping and an increased capability of recovering fluid with variable volumes.

Marginal Well

Embodiments of the present invention allow marginal wells to be placed back in service. Marginal wells are those wells that would otherwise be removed from production due to high energy and maintenance costs. Marginal wells are once again profitable when using a pulsar of an embodiment of the present invention.

Shallow Wells

Embodiments of the present invention can also recover fluid from shallow wells. Flexible lines and hydraulic reels are preferably used in isolated areas where electric power is not available. In one embodiment, a small power pack can be mounted on a skid with a reel that allows a pulsar unit to be installed in a very short time without the use of a rig.

Crooked Wells

A pulsar of the present invention can pump from crooked wells with no wear on the tubing that is placed in the hole from the surface to the downhole unit.

Angle Drilling

An embodiment of the present invention can be used in wells that are drilled off-set from a formation. Embodiments of the present invention can pump across a field and then pump in a vertical or any angled position downhole. With the high demand of horizontal drilling activity and the high cost of energy, embodiments of the present invention create a huge advantage in the marketplace by having the capability of being installed in a vertical position and deviating the angle to a horizontal position.

Efficient Pumping

Additional embodiments of the present invention allow pumping on both sides of a stroke in a downhole unit, which improves efficiency, thus offering an ideal design for application to utilizing solar and wind energy.

Filtering System

An embodiment of the present invention comprises a unique filtering system that prevents sand and other small debris from accumulating in the downhole unit. One of the major problems with downhole pump filtering systems in existing pumping technology is if a small grid filter is placed on the downhole pump, the debris have a tendency to pack off or clog the filter and prevent the flow of fluid into the pump. If a large grid is placed on the downhole unit, the filter allows sand and small debris to move into the pump, creating wear within the downhole unit. This embodiment of the present invention preferably backflushes the filter in each cycle of the pump, thereby allowing a smaller grid filter to be installed without clogging or packing off. This embodiment also filters out fracture sand, which increases the life of the plungers and barrels in the downhole unit, especially because of the presence of fracture sand in new wells.

Volume Adjustments

Once a power pack, pulsar and downhole unit of the present invention are installed and pumping, it is possible to adjust the output without a timer and without shutting the system off. The variable hydraulic pumps on the surface allow the owner/operator to adjust the system according to the output of the well.

Aesthetics

Embodiments of the present invention can be installed underground, rendering it invisible from the surface. The power pack and pulsar on the surface can be installed at ground level or below in order to maintain the appearance of the terrain.

Alternative Pump Design

Figure 9:
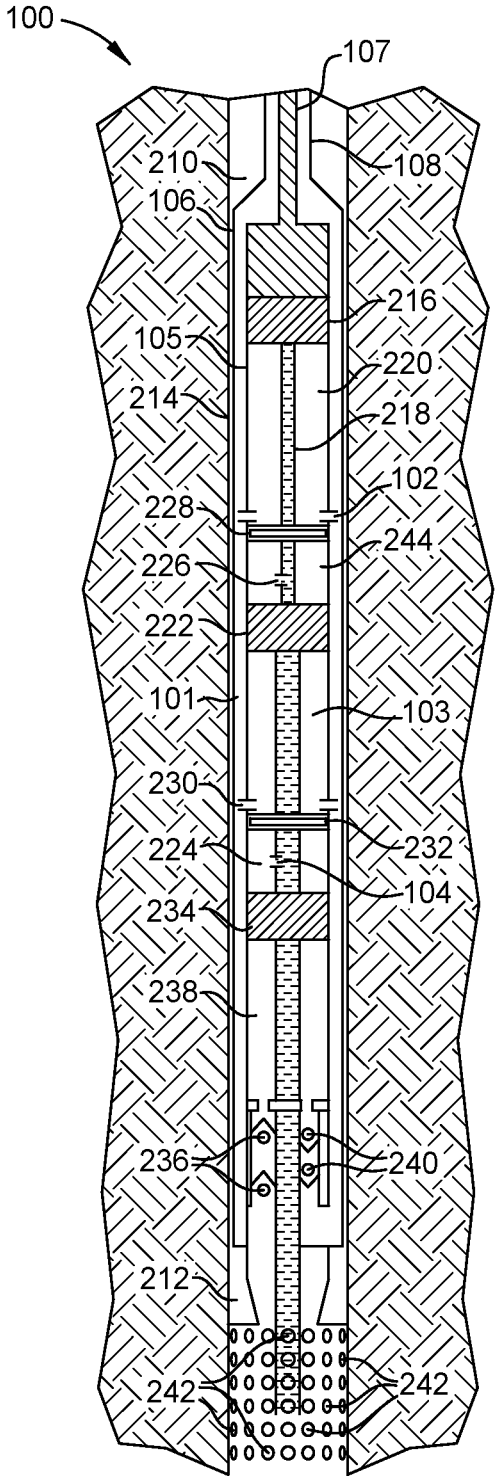
FIG. 9 is a section view schematic drawing illustrating an alternative version of the pump illustrated in FIG. 2.

FIG. 9 depicts a downhole hydraulic pump 100 that is an alternative design to the pumps configured as downhole units 200 and 800. Like downhole units 200 and 800, pump 100 is a positive displacement pump. The pump 100 is shown installed in a wellbore that has a casing 214. The pump has an inner housing 105, in which the piston plungers 216, 222, 234 operate, and an outer housing 106. There is annular space 101 for fluid to flow between the outer housing 106 and the inner housing 100.

The piston plungers are connected together by connecting tubes 218 and they work in unison. The connecting tubes 218 travels through the fixed pistons 228, 232 so that as the piston plungers 216, 222, and 234 reciprocate up and down, they cause a change in the volumes between the piston plungers 216, 222, 234 and the fixed pistons 228, 232.

A drive tubing 107 to surface is connected to the pump 100, and allows drive fluid from the surface to communicate to the top of the upper piston plunger 216. The hydrostatic head of the drive fluid plus pressure applied to the drive fluid by a pulsar 18 at surface (FIG. 1) applies pressure to the top of the upper piston plunger 216, causing the entire system of piston plungers 216, 222, and 234 and the connecting tubes 218 move downward. This downward motion causes fluid to be pushed from the chamber 220 below the piston 216 through holes 102 and into the annulus 101. This is further repeated with the fluid below piston 222 where the fluid in chamber 103 is pushed through the apertures 230 and into the annulus 101. Additionally, the fluid in chamber 238 below the lower piston 234 is pushed through the check-valve system 240 and into the same annulus 101. As the entire piston assembly 216, 222, and 234 moves downward, all three fluid volumes from chambers 220, 103, 238 are displaced into the annulus 101 and the fluid is forced upwards into the production tubing 108 that is attached to the top of the pump 100. Pressure from the surface drive unit is applied to the drive fluid to cause this fluid displacement to complete a production cycle of the pump 100.

During the downward movement of the piston assembly 216, 222, and 234, fluid must fill chambers 244 and 224 to allow the pistons to move. The fluid that transfers into these chambers comes from the well's natural fluid level and is conducted into these chambers up through the connecting tube 218 and through the holes 226 and 104, respectively, in the connecting tube 218.

Once the piston assembly 216, 222, and 234 has reached its full downward stroke position, the surface unit continues to pump which causes a spike in the pressure of the drive fluid and this spike in pressure causes a reversing valve to actuate at surface which then causes the hydraulic piston 22 and power piston 40 of pulsar 18 (FIG. 1) to reverse, thus relieving the fluid pressure applied to the drive fluid and thereby also reducing the pressure applied against the top of upper piston 216.

When this occurs, the upper piston 216 experiences the difference in hydrostatic pressure of the drive fluid from above, and the actual production fluid hydrostatic pressure from below, which is communicating back through holes 102. Further, the middle piston 222 experiences the difference in hydrostatic pressure from the natural well bore fluid level acting on the top of piston 222, and the hydrostatic pressure of the production fluid column acting on the bottom of piston 222. Finally, the piston 234 is pressure balanced with natural well bore fluid hydrostatic pressure acting on both sides. The result is that there is a pressure over-balance in favor of the hydrostatic pressure acting on piston 222 and this causes the entire piston assembly to move back to a full upstroke position. Such upward movement further displaces well fluid from chamber 224 back into the well, while drawing new well bore fluid into the production chamber 238 through the check valve assembly 236, creating a new volume of fluid to be produced on the next downward pump cycle when pressure is reapplied to the drive fluid by the pulsar 18. This completes one full cycle of the pump 100. The above operating cycles are repeated, resulting in additional production fluid being moved into and through the production tubing 108, and being produced from the wellbore.

For every down-stoke, the contents of all three chambers 220, 103, 238 are displaced into the annulus 101. When the surface pressure is reversed, only two of the three chambers-worth of this production fluid volume returns into the pump 100 while a new (third) volume of fluid is pulled into the lower chamber 238 from the wellbore. The two critical factors that make this happen are the check valves 236, 240 and the resetting of the pump 100 using the difference in hydrostatic pressures.

Multiple Hydraulic Pumps in a Well to Create a "Downhole Pipeline"

In another embodiment, multiple (one or more) hydraulic pumps may be installed in a well, which work in tandem to move the fluids from a lower portion to an upper portion of the well. The multiple hydraulic pumps may include pumps of the present disclosure. A first pump in a first location in the well may receive fluid, such as a production fluid, and move the production fluid towards a second pump. The second pump may be located proximate to the first pump, or may be at a location in the well that is distant from the first pump. The second pump may receive the production fluid from the first pump and move the production fluid toward the top of the well and produce the production fluid from the well. Known techniques rely on the well's natural energy or gravitational forces to move the production fluid from a zone of fluid influx into the wellbore to a pump located away from the zone of fluid influx to enable the pump to move the production fluid to the surface. In contrast, this embodiment allows the production fluid to be gathered and introduced into production tubing at any point in a wellbore, such as along a horizontal portion of a wellbore, without relying so much on the well's natural energy or gravitational forces to move the production fluid from a zone of fluid influx into the wellbore to the pump.

Figure 10:
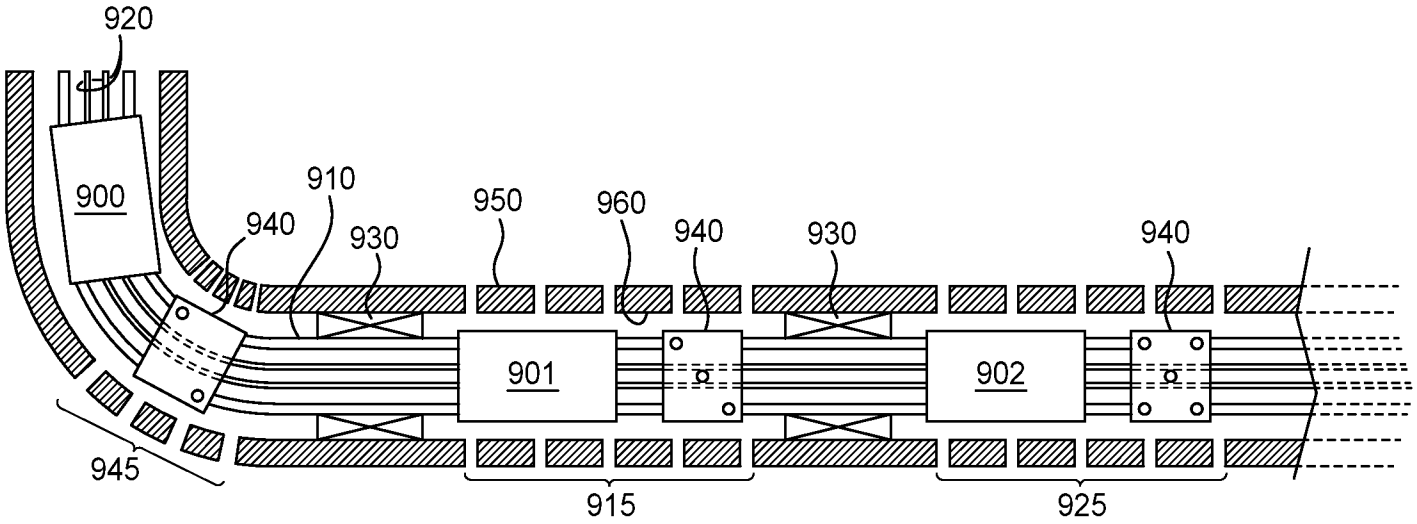
FIG. 10 is a section view schematic drawing depicting multiple pumps that are connected together along a common tubing string.

FIG. 10 depicts multiple pumps that are connected together along a common tubing string 910 in a wellbore 950. The pumps are also connected together by a connecting pipe 920 shown to be installed inside of the tubing string 910. In one embodiment, connecting pipe 920 is used to convey hydraulic drive pressure to the pumps and the production fluid is returned in an annulus formed between connecting pipe 920 and the tubing string 910. In other embodiments, the connecting pipe 920 may be replaced by a hydraulic control line (not shown) that is secured to the outside of the tubing string 910, creating an eccentric rather than the concentric version of the arrangement shown in FIG. 10.

The wellbore 950 may have a producing section that is substantially horizontal, as shown in FIG. 10. Additionally, or alternatively, the wellbore may have a producing section that is not substantially horizontal. The producing section may include a first zone of fluid influx 915 and a second zone of fluid influx 925.

Production pump 900 may be configured to move production fluid through the tubing string 910 towards, and out of, the top of the wellbore 950, thereby producing the production fluid from the wellbore 950. A first transfer pump 901 may be configured to receive production fluid via a portion of the tubing string 910 below the first transfer pump 901, and move the production fluid through the tubing string 910 above the first transfer pump 901 toward the production pump 900. The first transfer pump 901 may be located proximate to, such as near to or within, the first zone of fluid influx 915 into the wellbore 950. The first transfer pump 901 may also convey production fluid that enters the wellbore 970 in the first zone of fluid influx 915 toward the production pump 900.

A second transfer pump 902 may be configured to receive production fluid via a portion of the tubing string 910 below the second transfer pump 902, and move the production fluid through the tubing string 910 above the second transfer pump 902 toward the first transfer pump 901. The second transfer pump 902 may be located proximate to, such as near to or within, the second zone of fluid influx 925 into the wellbore 950. The second transfer pump 902 may also convey production fluid that enters the wellbore 950 in the second zone of fluid influx 925 toward the first transfer pump 901.

Any one or more of production pump 900, first transfer pump 901, and second transfer pump 902 may be positive displacement pumps, such as a pump or downhole unit of the present disclosure.

FIG. 10 further depicts the horizontal portion of the wellbore 950 divided into multiple zones by packers 930 that serve to isolate areas between the tubing string 910 and wellbore wall 960. The isolated areas in FIG. 10 may correspond to the first zone of fluid influx 915 and the second zone of fluid influx 925. The packers can be swell packers, open-hole hydraulic packers, cup packers, or any type of packer that will create a barrier to create and maintain the zones. Thus, the zones of fluid influx 915, 925 may be discrete. The wellbore wall 960 may include any one or more of a casing, a liner, a slotted liner, a pre-perforated liner, a sand control screen, exposed unlined reservoir rock, or combination(s) thereof.

As shown in FIG. 10, the first and second transfer pumps 901, 902 are installed so as to be interspersed in the tubing string 910 between pairs of the packers such that the first transfer pump 901 is located proximate to the first zone of fluid influx 915, and the second transfer pump 902 is located proximate to the second zone of fluid influx 925. As shown, all of the pumps 900, 901, 902 are connected together by tubing string 910 and connecting pipe 920. Therefore, pumps 900, 901, 902 may be operated simultaneously through the application of hydraulic drive pressure down connecting pipe 920 to move production fluid along the wellbore and towards the surface through the annulus between the tubing string 910 and connecting pipe 920.

Production fluid contained within a geological formation may enter the wellbore 950 at the first zone of fluid influx 915 and at the second zone of fluid influx 925. The second transfer pump 902 may receive production fluid from the second zone of fluid influx 925. The second transfer pump 902 may receive production fluid from a third zone of fluid influx (not shown) via the portion of the tubing string 910 that extends below the second transfer pump 902. The production fluid from the second zone of fluid influx 925 and the third zone of fluid influx may be commingled. The second transfer pump 902 may move the commingled production fluid through the tubing string 910 toward the first transfer pump 901. In some embodiments, there may not be any production fluid from the second zone of fluid influx 925, and the second transfer pump 902 may move only the fluid received via the portion of the tubing string 910 that extends below the second transfer pump 902.

The first transfer pump 901 may receive production fluid from the first zone of fluid influx 915. The first transfer pump 901 may receive production fluid from the second transfer pump 902 via the tubing string 910. The production fluid from the second transfer pump 902 and the first zone of fluid influx 915 may be commingled. The first transfer pump 901 may move the commingled production fluid through the tubing string 910 toward the production pump 900. In some embodiments, there may not be any production fluid from the first zone of fluid influx 915, and the first transfer pump 901 may move only the fluid received via the portion of the tubing string 910 that extends below the first transfer pump 901.

The production pump 900 may move the production fluid along the wellbore, towards the surface through the annulus between the tubing string 910 and connecting pipe 920, and out of the wellbore 950 so that the production fluid is produced from the wellbore 950. In some embodiments, the production pump may receive production fluid from an additional zone of fluid influx 945 above the first zone of fluid influx 915. The production fluid from the first transfer pump 901 and the additional zone of fluid influx 945 may be commingled and moved towards the surface through the annulus between the tubing string 910 and connecting pipe 920 so that the production fluid is produced from the wellbore 950.

In the illustrated embodiment, all the production fluid that originates from zones of fluid influx below the second transfer pump 902 and becomes produced from the wellbore 950 passes through the second transfer pump 902. In the illustrated embodiment, all the production fluid that originates from the second zone of fluid influx 925 and becomes produced from the wellbore 950 passes through the second transfer pump 902.

In the illustrated embodiment, all the production fluid that originates from zones of fluid influx below the first transfer pump 901 and becomes produced from the wellbore 950 passes through the first transfer pump 901. In the illustrated embodiment, all the production fluid that originates from the first zone of fluid influx 915 and becomes produced from the wellbore 950 passes through the first transfer pump 901. Hence, in the illustrated embodiment, all the production fluid that passes through the second transfer pump 902 also passes through the first transfer pump 901.

In the illustrated embodiment, all the production fluid that originates from zones of fluid influx below the packer 930 between the production pump 900 and the first transfer pump 901 and becomes produced from the wellbore 950 passes through the production pump 900. Hence, in the illustrated embodiment, all the production fluid that passes through the first transfer pump 901 also passes through the production pump 900. In some embodiments, an additional packer 930 may seal the annular space between the tubing string 910 and the wellbore wall 960 above the production pump 900. In such embodiments, all the production fluid that originates from the additional zone of fluid influx 945 and becomes produced from the wellbore 950 passes through the production pump 900.

The tubing string 910 and the packers 930 create discrete sealed volumes in the wellbore 950, each discrete sealed volume containing a transfer pump, such as first transfer pump 901 or second transfer pump 902. Thus, a drawdown applied by any one of the first and second transfer pumps 901, 902 is not significantly offset by a change in level of a fluid surrounding the first and second transfer pumps 901, 902. The first and second transfer pumps 901, 902 may be operated to draw production fluid into the wellbore 950 through each respective discrete zone of fluid influx 915, 925. In other words, transfer pump 901 may be operated to apply a suction, or drawdown, on the reservoir only at the first zone of fluid influx 915, and independent of the suction, or drawdown, applied on the reservoir at the second zone of fluid influx 925 by transfer pump 902.

In embodiments in which the first and second transfer pumps 901, 902 are positive displacement pumps, operation of the first and second transfer pumps 901, 902 to draw fluids into the first and second transfer pumps 901, 902 may significantly reduce the pressure of fluids within the wellbore 950 proximate to the first and second zones of fluid influx 915, 925. In some embodiments, the pressure in the wellbore 950 proximate to at least one of the first and second zones of fluid influx 915, 925 may be reduced to a magnitude that is, at least temporarily, significantly less than the in situ pressure of the surrounding geological formation. In some embodiments, the pressure in the wellbore 950 proximate to a zone of fluid influx 915, 925 may be reduced to a magnitude that is, at least temporarily, about 1,000 psi (68.9 bar) or less, about 500 psi (34.5 bar) or less, about 250 psi (17.2 bar) or less, about 200 psi (13.8 bar) or less, about 150 psi (10.3 bar) or less, about 100 psi (6.9 bar) or less, or about 50 psi (3.4 bar) or less. In some embodiments, the pressure in the wellbore 950 proximate to a zone of fluid influx 915, 925 may be reduced to a magnitude that is, at least temporarily, substantially equal to atmospheric pressure. In some embodiments, the pressure in the wellbore 950 proximate to a zone of fluid influx 915, 925 may be reduced to a magnitude that is, at least temporarily, less than atmospheric pressure.

In some embodiments, as shown in FIG. 10, one or more inflow control devices 940 may be located along the length of the wellbore 950 adjacent each pump in the various zones. In the embodiment shown, the inflow control devices 940 are located just upstream of their respective pump. The inflow control devices 940 can be simple orifices, autonomously controlled or remotely controlled systems. The purpose of each inflow control devices 940 is to control the amount or percentage of inflow that each pump 900, 901, 902 will receive from a particular zone in the wellbore 950. By using multiple inflow control devices 940 and setting each inflow control device 940 to a different inflow percentage, an operator can control the amount of fluid produced from a particular zone of the well, thereby insuring that the well is contributing produced fluids from the toe, or most distant end of the wellbore and the mid-section as well as the heel section of the wellbore 950. Such a technique may be used to normalize the inflow characteristics of the various zone of fluid influx such that premature water or gas breakthrough due to high drawdown pressures or preferential flow in certain zones may be avoided.

In other embodiments, the inflow control devices 940 may be omitted. By using positive displacement pumps, such as those of the present disclosure, as pumps 900, 901, and 902, each pump may be sized according to a desired production volume from each zone of fluid influx. For example, the second transfer pump 902 may be sized to pump all the production fluid that is produced from zones below the second zone of fluid influx 925 plus a desired quantity of production fluid that enters the wellbore 950 at the second zone of fluid influx 925. The first transfer pump 901 may be sized to pump the output of the second transfer pump 902 plus a desired quantity of production fluid that enters the wellbore 950 at the first zone of fluid influx 915. The production pump 900 may be sized to pump the output of the first transfer pump 901 only. Alternatively, if production is desired from the additional zone of fluid influx 945, the production pump 900 may be sized to pump the output of the first transfer pump 901 plus a desired quantity of production fluid that enters the wellbore 950 at the additional zone of fluid influx 945.

By using the arrangement of FIG. 10, with or without the inflow control devices 940, to control the amount of fluids contributed from each zone in the well, the pumps 900, 901, 902 will act in conjunction with each other to gather fluid and move it along the production tubing towards the surface of the well for collection. In this manner, a controlled and predetermined amount of fluid coming from each section (toe, mid, heel) of the well. The result is a downhole pipeline arrangement similar to a surface pipeline with pump stations.

Single Hydraulic Pump in a Horizontal Well to Produce Multiple Zones

Figure 11:
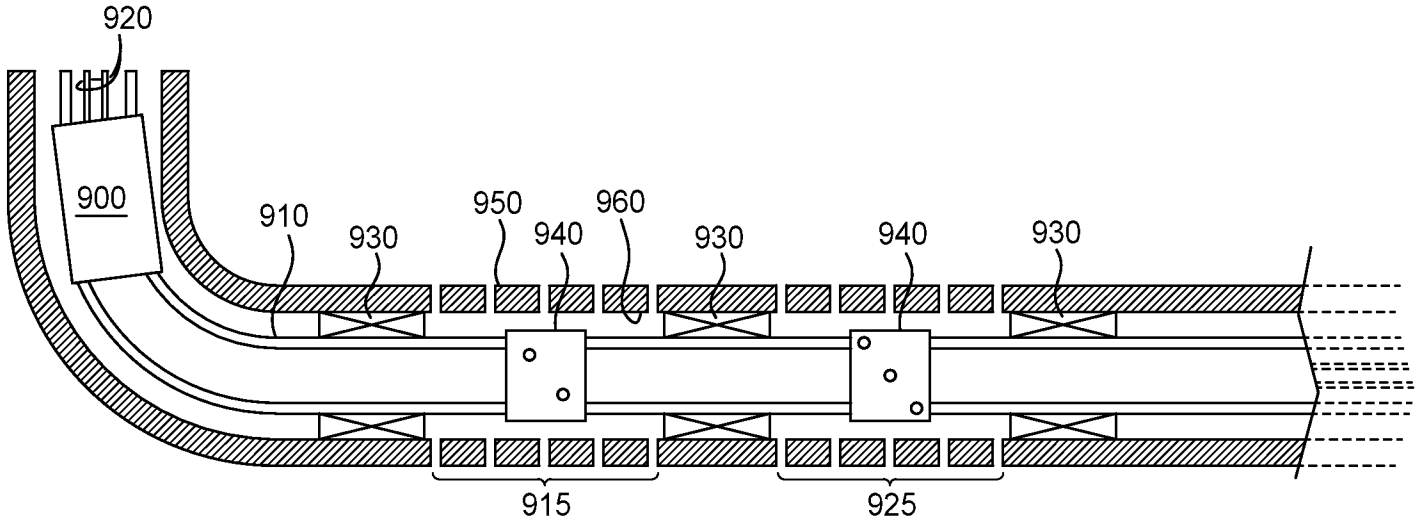
FIG. 11 is a section view schematic drawing depicting a singular pump connected to a tubing string or suction tube.

In yet another embodiment, a single hydraulic pump may be installed in a wellbore to move the fluids from multiple zones in the lower portion of the well to the upper portion thereof. The wellbore may have a producing section that is substantially horizontal, as shown in FIG. 11. Additionally, or alternatively, the wellbore may have a producing section that is not substantially horizontal.

FIG. 11 depicts a single production pump 900 connected to a tubing string 910. Further, the production pump 900 is also connected to a connecting pipe 920 which, in the case of this embodiment, extends from the surface of the well and terminates at the production pump 900. As in other embodiments, connecting pipe 920 is used to convey hydraulic drive pressure to the production pump 900 and the production fluid is returned up the annulus formed between the tubing string 910 and the connecting pipe 920. As with the embodiment of FIG. 10, the connecting pipe 920 may be replaced by a hydraulic control line (not shown) that is secured to the outside of the tubing 910, creating an eccentric rather than the concentric version of the arrangement shown in FIG. 11.

In the embodiment of FIG. 11, like the one shown in FIG. 10, the wellbore 950 is equipped with a number of packers 930 dividing the horizontal portion of wellbore 950 into zones of fluid influx 915, 925, and each zone of fluid influx 915, 925 includes its own inflow control device 940. Unlike FIG. 10, the embodiment of FIG. 11 includes a single production pump 900 at or near a heel of the horizontal portion of wellbore 950, but no other pumps in the horizontal portion of the wellbore 950. The tubing string 910 extends below the production pump 900 such that production fluid from each zone of fluid influx 915, 925 is drawn into the production pump 900 through the tubing string 910. Thus, a drawdown applied by production pump 900 to draw fluids into production pump 900 is not significantly offset by a change in level of a fluid surrounding the production pump 900. In the illustrated embodiment, all the production fluid that originates from the zones of fluid influx 915, 925 and becomes produced from the wellbore 950 passes through the production pump 900.

By using a positive displacement pump, such as a pump or downhole unit of the present disclosure, as production pump 900 in combination with the tubing string 910 and packers 930, the production pump 900 may be operated to draw production fluid into the wellbore 950 through each zone of fluid influx 915, 925. Similarly, by using a positive displacement pump, such as a pump or downhole unit of the present disclosure, as production pump 900, the volume of production fluid that is produced from the wellbore 950 may be controlled. It follows that by using the inflow control devices 940 in the arrangement depicted in FIG. 11, the relative volumetric contribution from each zone of fluid influx 915, 925 may be controlled. By utilizing this embodiment to control the amount of fluids contributed from each zone in the wellbore 950, the single production pump 900 will act to draw fluid from the tubing string 910 below in a manner whereby a predetermined amount of fluid is gathered from each section of the wellbore 950.

While the foregoing is directed to embodiments of the present disclosure, other and further embodiments of the disclosure may be devised without departing from the basic scope thereof, and the scope thereof is determined by the claims that follow.

What is claimed is:

1. A method of producing fluid from a wellbore comprising:

operating a first pump located proximate to a first zone of fluid influx in the wellbore to draw a first production fluid from a reservoir into the wellbore at the first zone of fluid influx;

operating a second pump located proximate to a second zone of fluid influx in the wellbore to draw a second production fluid from the reservoir into the wellbore at the second zone of fluid influx;

wherein:

the first pump is coupled to a first section of a tubing string extending above the first pump and to a second section of the tubing string extending below the first pump;

a first packer seals a first annular space around the first section of the tubing string;

a second packer seals a second annular space around the second section of the tubing string below the first pump;

the second pump is coupled to the second section of the tubing string below the second packer;

the second pump is coupled to a third section of the tubing string extending below the second pump;

a production pump is coupled to the first section of the tubing string in the wellbore above the first pump; and a drive fluid conduit extends from the production pump to the first pump and from the first pump to the second pump;

operating the second pump to move the second production fluid from the third section of the tubing string and into the second section of the tubing string;

operating the first pump to move the first production fluid and the second production fluid from the second section of the tubing string and into the first section of the tubing string;

powering the production pump, the first pump, and the second pump by a drive fluid supplied through the drive fluid conduit; and operating the production pump to produce the first production fluid and the second production fluid from the wellbore.

2. The method of claim 1, further comprising regulating a flow of the first production fluid between the reservoir and the first pump.

3. The method of claim 2, wherein regulating the flow of the first production fluid between the reservoir and the first pump is achieved with an inflow control device.

4. The method of claim 1, further comprising regulating a flow of the second production fluid between the reservoir and the second pump.

5. The method of claim 4, wherein regulating the flow of the second production fluid between the reservoir and the second pump is achieved with an inflow control device.

6. The method of claim 1, wherein the first and second pumps are operated simultaneously by the drive fluid.

7. The method of claim 6, wherein the production pump and the first pump are operated simultaneously by the drive fluid.

8. The method of claim 1, wherein the first and second pumps are positive displacement pumps.

9. The method of claim 1, wherein the production pump is a positive displacement pump.

10. The method of claim 1, wherein the drive fluid conduit is disposed inside the tubing string.

11. A method of producing fluid from a wellbore comprising:

operating a lower pump in the wellbore to draw a lower production fluid from a reservoir into the wellbore at a lower zone of fluid influx;

operating the lower pump to move the lower production fluid toward an upper pump located in the wellbore;

operating the upper pump to produce the lower production fluid from the wellbore;

powering the upper pump by a drive fluid supplied through a drive fluid conduit; and powering the lower pump by the drive fluid, wherein the drive fluid conduit extends from the upper pump to the lower pump.

12. The method of claim 11, further comprising:

operating the upper pump to draw an upper production fluid from the reservoir into the wellbore at an upper zone of fluid influx; and operating the upper pump to produce the upper production fluid from the wellbore.

13. The method of claim 12, further comprising commingling the upper production fluid with the lower production fluid.

14. The method of claim 12, further comprising regulating a flow of the upper production fluid between the reservoir and the upper pump.

15. The method of claim 11, further comprising regulating a flow of the lower production fluid between the reservoir and the lower pump.

16. The method of claim 11, wherein the upper and lower pumps are operated simultaneously by the drive fluid.

17. The method of claim 11, wherein the upper and lower pumps are positive displacement pumps.

* * * * *